United States Patent [19]

Nakayama et al.

[11] 4,345,886

[45] Aug. 24, 1982

[54] ROTARY COMPRESSOR WITH VANES IN THE HOUSING AND SUCTION THROUGH THE ROTOR

[75] Inventors: Shozo Nakayama; Mitsuhiro Hattori; Hiromitsu Ono, all of Kariya, Japan

[73] Assignee: Kabushiki Kaisha Toyoda Jidoshokki Seisakusho, Kariya, Japan

[21] Appl. No.: 247,953

[22] Filed: Mar. 26, 1981

Related U.S. Application Data

[63] Continuation of Ser. No. 8,918, Feb. 5, 1979, abandoned.

[30] Foreign Application Priority Data

| | | | |
|---|---|---|---|
| Mar. 10, 1978 | [JP] | Japan | 53-27973 |
| Mar. 14, 1978 | [JP] | Japan | 53-32261 |
| Mar. 14, 1978 | [JP] | Japan | 53-32262 |
| Mar. 14, 1978 | [JP] | Japan | 53-32419 |
| Mar. 15, 1978 | [JP] | Japan | 53-33212 |
| Mar. 15, 1978 | [JP] | Japan | 53-33213 |
| Apr. 1, 1978 | [JP] | Japan | 53-38391 |
| Apr. 1, 1978 | [JP] | Japan | 53-42720 |
| Apr. 3, 1978 | [JP] | Japan | 53-39023 |
| Apr. 3, 1978 | [JP] | Japan | 53-43429 |
| Apr. 4, 1978 | [JP] | Japan | 53-39367 |
| Apr. 4, 1978 | [JP] | Japan | 53-39368 |

[51] Int. Cl.[3] ..... F04C 18/00; F04C 27/00; F04C 29/02

[52] U.S. Cl. ..... 418/100; 418/102; 418/124; 418/141; 418/142; 418/183; 418/248; 418/249

[58] Field of Search ..... 418/100, 102, 183, 186–188, 418/248, 249, 124, 141, 142

[56] References Cited

U.S. PATENT DOCUMENTS

| | | | |
|---|---|---|---|
| 841,987 | 1/1907 | Lecaime | 418/186 |
| 936,932 | 10/1909 | Neumann | 418/188 |
| 1,851,193 | 3/1932 | Laraque | 418/183 |
| 2,215,873 | 9/1940 | Gahm | 418/186 |
| 3,191,541 | 6/1965 | Brown | 418/188 |

*Primary Examiner*—John J. Vrablik
*Attorney, Agent, or Firm*—Jordan and Hamburg

[57] ABSTRACT

A rotary compressor for compressing fluid. A housing having a cylindrical internal cavity is provided with vanes and delivery ports. A rotor is rotatably mounted in the housing. The rotor has a portion for making a sealing contact with the inner peripheral surface of the housing. The rotor has a suction chamber formed therein. The number of the vanes is greater by 1 (one) than the number of the sealing contacts between the rotor and the inner peripheral surface of the housing. At least one suction port is formed through the wall of the rotor, so that the fluid in the suction chamber may be sucked into the working chamber defined by the vanes, rotor and the housing. The suction port is so located that, when a working chamber has been expanded to its maximum volume, the suction port is positioned between the vane located at the leading side of the working chamber as viewed in the direction or rotation of the rotor and the sealing portion closer to the vane. The fluid compressed in the working chamber is delivered to the outside of the housing through the delivery ports.

15 Claims, 32 Drawing Figures

PRIOR ART

ROTARY COMPRESSOR WITH VANES IN THE HOUSING AND SUCTION THROUGH THE ROTOR

This is a continuation, of application Ser. No. 8,918, filed Feb. 5, 1979, now abandoned.

BACKGROUND OF THE INVENTION

The present invention relates to a compressor and, more particularly, to a compressor for compressing refrigerant, suitable for use in air conditioner for vehicles.

Vane type rotary compressors have been rated high, because of high driving and compression efficiencies. Particularly, the vane type rotary compressor having vanes disposed in the stationary housing attracts attention, because of advantages of high driving efficiency and reduced cost of production which are derived from the simplification of construction of rotary parts.

This type of compressor, however, involves various problems. Namely, in existing compressors of the kind described, the suction and delivery ports, through which a working chamber defined by the housing, rotor and the vanes communicate with suction and delivery side, are formed stationarily in the housing. Therefore, a temperature gradient is inevitably generated locally in the housing, due to the difference between the refrigerant temperature at the suction side and that at the delivery side, possibly resulting in the thermal distortion of the housing. This arrangement also leads to a poor efficiency of cooling of the rotor, resulting in a temperature rise only in the rotor. In addition, since the parts of the housing in sliding contact with the rotor, vanes and bearings are lubricated by the lubricant forcibly supplied by an oil pump incorporated in the compressor, the cost of the compressor has been rendered high, due to the installation of the oil pump and accessories.

It is therefore an object of the invention to provide a compressor which is free from the distortion attributable to the difference in temperature of the fluid between the suction and delivery sides of the compressor.

It is another object of the invention to provide a compressor which can increase the efficiency of sucking of the fluid to be handled into the working chamber defined in the housing.

It is still another object of the invention to provide a compressor in which the flow of the fluid in the working chamber is suitably utilized such that the oil content in the fluid is supplied to the portions which require lubrication, e.g. the end surface of the rotor, bearings and shaft seal of the driving shaft of the rotor.

It is a further object of the invention to provide a compressor in which the reversing of the fluid compressed in the working chamber of the housing back to the suction chamber is prevented to improve the volume efficiency of the compressor. It is a still further object of the invention to provide a compressor in which the supply of the lubrication oil to the end surface of the rotor is made without fail, so as to improve the working efficiency and the durability of the compressor.

It is a still further object of the invention to provide a compressor in which the rate of lubrication oil supply to the longer-diameter part of the rotor, which is rotated at a higher peripheral or tangential speed, is increased as compared with the other portions, so that the wear at these longer-diameter portions may be reduced.

It is a still further object of the invention to provide a compressor in which the pressure at which the vanes contact the rotor is optimized to increase the compression efficiency and durability of the compressor, and to reduce the mechanical impact or shock at the starting of the rotor.

It is a still further object of the invention to provide a compressor in which the compression work is commenced without fail, at the time of starting of the rotation of the rotor.

It is a still further object of the invention to provide a compressor in which the amount of oil staying in the rotor during running is adjusted optimumly.

These and other objects of the invention will become clear from the following description of the preferred embodiment taken in conjunction with the accompanying drawings, as well as from the appended claims. Various advantages derived from the invention which are not mentioned in the specification with be obvious to those skilled in the art.

DESCRIPTION OF THE PREFERRED EMBODIMENTS

Figure 1:
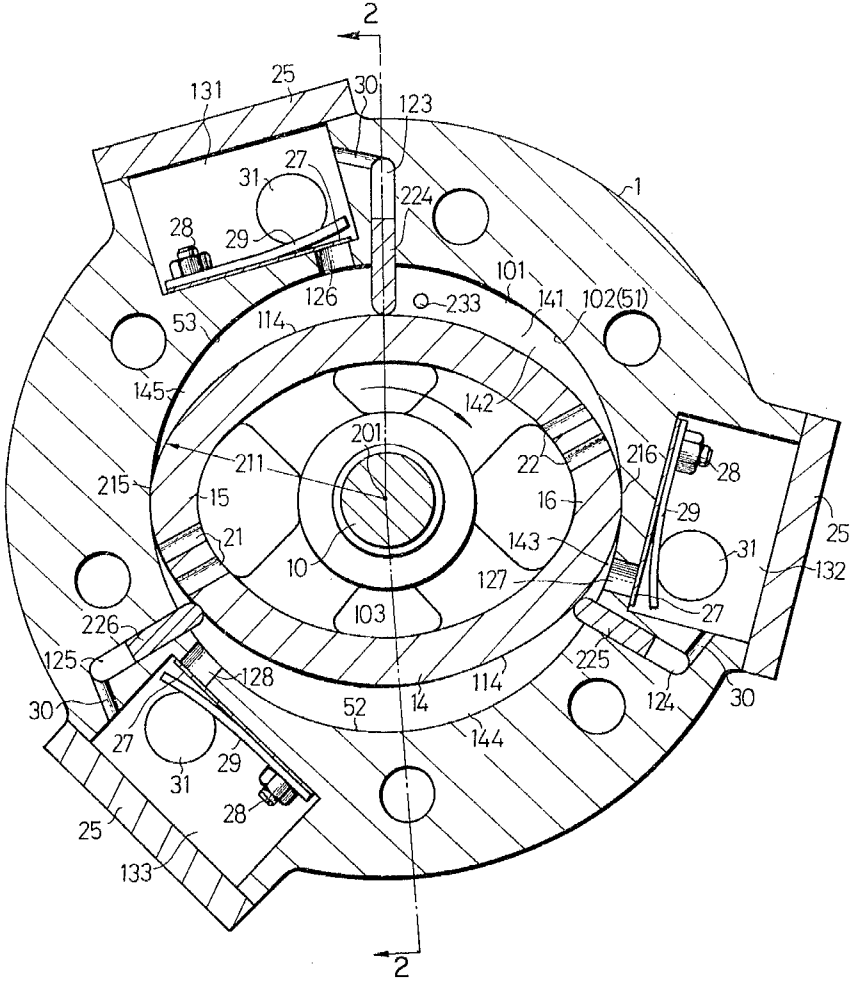
FIG. 1 is a sectional view of a compressor constructed in accordance with a first embodiment of the invention.

A first embodiment of the invention will be described hereinunder with reference to FIGS. 1 to 5. A cylindrical center housing 1 has a circular cross-sectioned cylinder chamber 101 formed therein. A front and a rear housings 2,3 are attached to left and right end surfaces of the housing 1, by means of a plurality of bolts 5, through "0" rings 4.

Figure 2:
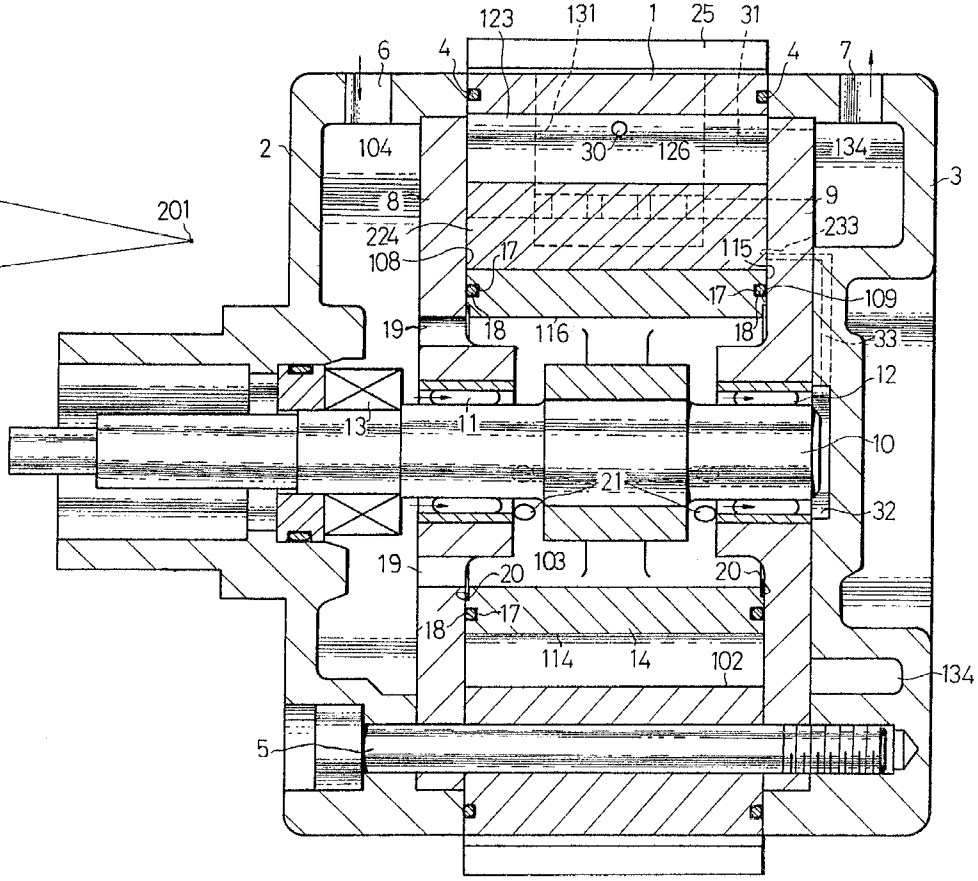
FIG. 2 is a sectional view taken along the line 2—2 of FIG. 1.

As will be seen from FIG. 2, the front housing 2 has an aperture 6 formed in its peripheral portion, to which connected is a conduit (not shown) for supplying the refrigerant. Also, a conduit (not shown) for discharging the refrigerant is connected to an aperture 7 formed in the peripheral portion of the rear housing 3.

Reference numerals 8 and 9 denote front and rear side plates disposed between the center housing 1 and the front housing 2, and between the center housing 1 and the rear housing 3, respectively. These front and rear side plates constitute both side walls of the cylindrical cylinder chamber 101. The side plate 8 constitute, in combination with the housing 2, an auxiliary suction chamber 104, while an auxiliary delivery chamber 134 is constituted by the side plate 9 and the housing 3, respectively.

A rotor shaft 10 is rotatably supported by the central portions of the side plates 8, 9, through respective bearings 11, 12. The front end portion of the rotor shaft 10 extends outwardly through the center of the front housing 2. A seal member 13 is disposed between the front housing 2 and the rotor shaft 10.

A rotor 14 having an elliptic cross-section is carried by the rotor shaft 10 and accomodated by the cylinder chamber 101. The shape of the inner periphery of the rotor 14 is similar to that of the outer periphery of the same In this embodiment, the rotor 14 is designed to have a substantially uniform wall thickness.

The rotor 14 has a pair of longer-diameter portions 15, 16 the radial distance 211 of which from the axis 201 of the rotor shaft 10 is greater than that of any other portion of the rotor 14. These longer-diameter portions 15, 16 are so designed that their outer peripheral surfaces 215, 216 are positioned close as possible to the inner peripheral surface 102 of the cylinder chamber 101, as will be seen from FIG. 3, so that a pair of working chambers which moves in the direction of rotation of the rotor 14 as the latter rotates are formed between the outer peripheral surface 114 of the rotor 14 and the inner peripheral surface of the cylinder chamber 101. At the same time, the both end surfaces 115 of the rotor 14 are positioned as close as possible to the inner surfaces 108, 109 of the side plates 8, 9. More specifically, as shown in FIG. 4, the entire periphery of the end surface 115 of the rotor 14 is provided with a seal groove 17 receiving a seal ring 18 which is kept in sliding contact with the inner surfaces 108, 109 of the side plates 8, 9.

Figure 3:
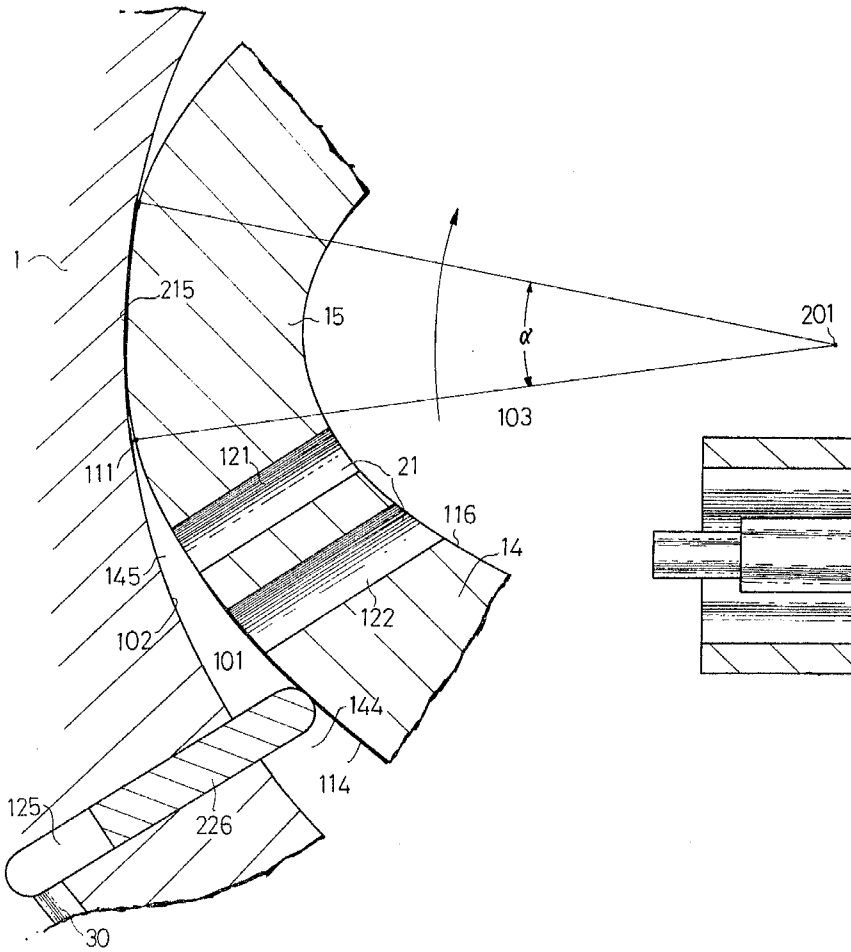
FIG. 3 is an enlarged sectional view of a longer-diameter portion of the rotor of the compressor.
Figure 5:
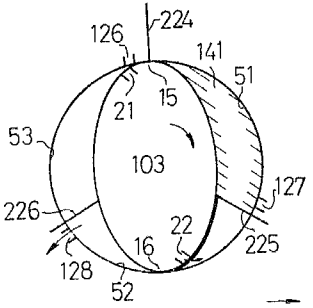
Figure 5:
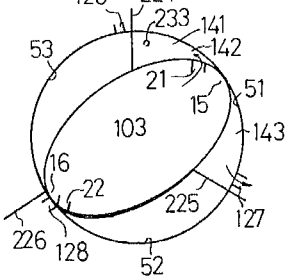
Figure 5:
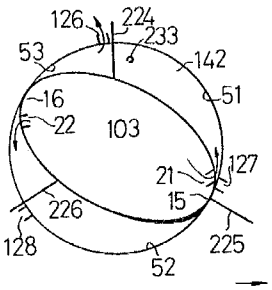
Figure 5:
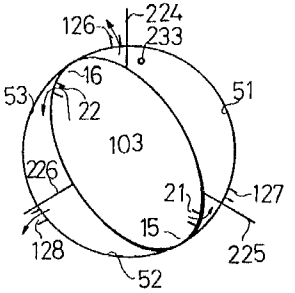
Figure 5:
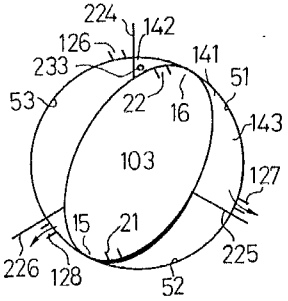
Figure 5:
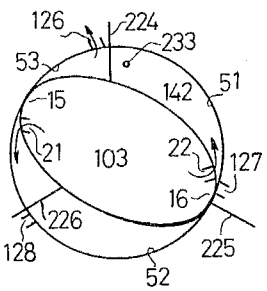

The outer peripheral surfaces 215, 216 of the longer-diameter portions 15, 16 of the rotor 14 are formed to have arcuate form of a radius of curvature substantially equal to that of the inner peripheral surface 102 of the cylinder chamber 101, as shown in FIG. 3, and are made to have a length of between about 10 and 20 mm (the angle $\alpha$ formed between two radial lines centered at the axis 201 and defining both ends of each outer peripheral surface 215, 216 is selected to be about 10° to 20°, in this embodiment), so as to keep a good seal in cooperation with the inner peripheral surface 102 of the cylinder chamber 101.

A suction chamber 103 is defined, as shown in FIG. 2, by the elliptic inner peripheral surface 116 of the rotor 14 and both side plates 8, 9. The suction chamber 103 is made to communicate with an auxiliary suction chamber 104 formed in the front housing 2, through a plurality of introduction ports 19 formed near the center of the front side plate 8.

Figure 4:
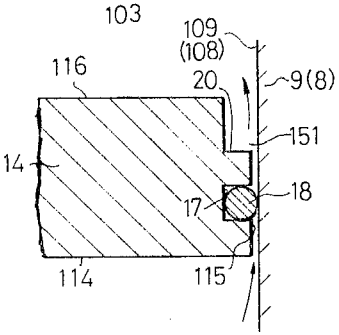
FIG. 4 is an enlarged sectional view showing the end configuration of the rotor as shown in FIG. 2, FIGS. 5*a* to 5*f* are illustrations for explaining the suction and delivery strokes performed by the rotor in a cylinder chamber.

As will be seen from FIG. 4, the inner peripheral surface 116 of the rotor 14 is notched in a stepped manner at its both end portions, so as to form oil pools 20, so that the oil content of the refrigerant may effectively be supplied to the seal groove 17 and the seal ring 18 as the rotor 14 rotates.

A reference numeral 21 denotes four first suction ports which are formed in the outer periphery of the rotor 14 at a portion of the latter just behind or trailing side of the outer peripheral surface 215 of the longer-diameter portion 215 as viewed in the direction of rotation of the rotor 14. These first suction ports intercommunicate the working chamber and the suction chamber 103 in the rotor 14, so as to supply the refrigerant from the suction chamber 103 to the working chamber.

A reference numeral 22 denotes four second suction ports which are formed, similarly to the first suction ports 21, in the outer peripheral surface of the rotor 14, just behind or trailing side of the outer peripheral surface 216 of the longer-diameter portion 16. These second suction ports 22 also intercommunicate the suction chamber 103 of the rotor 14 and the working chamber, so as to supply the refrigerant from the suction chamber 103 to the working chamber.

Three vane grooves 123–125 are formed in the inner peripheral surface 102 of the cylinder chamber 101 at 120° interval. These vane grooves 123–125 receive respective vanes 224–226 for free reciprocatory sliding movement in the radial direction. The radially inner end of each vane slidingly contacts the outer peripheral surface 114 of the rotor 14.

One 224 of these three vanes is positioned at the uppermost portion of the cylinder chamber 101, so that it may slidingly contact the outer peripheral surface 114 of the rotor 14 due to its weight. Other two vanes slide obliquely downwardly along the vane grooves 124, 125, due to their weights, when the rotor 14 is kept stopped, so as to clear the outer peripheral surface 114 of the rotor 14.

However, while there is a back pressure in the back side of each vane 225,226, during the suspension after running of the compressor, each vane 225, 226 is kept in contact with the outer peripheral surface 114 of the rotor 14.

Three delivery chambers 131–133 are formed in the outer peripheral surface of the center housing 1, so as to open outwardly, at portions just behind or trailing side of respective vanes 224–226. The opened end of each delivery chamber is closed by a cover 25.

Three delivery ports 126–128 are formed in the center housing 1, at portions of the latter just behind or trailing side of respective vane grooves 123–125, so as to make respective working chambers communicate corresponding delivery chambers 131–133, thereby to supply the refrigerant compressed in respective working chambers to the delivery chambers 131–133.

A check valve 27 consisting of a thin web material is attached by bolts 28 to the bottom of each delivery chamber 131–133, so as to open and close each delivery port 126–128. The stroke or lift of the check valve 27 is limited by a stopper 29 which is attached to the back side of each check valve 27 by the bolt 28.

Passages 30 are formed in the center housing 1, through which each vane groove 123–125 communicates corresponding delivery chamber 131–133. Each passage 30 introduces the refrigerant forcibly fed into each delivery chamber 131–133 into corresponding vane groove 123–125, so as to press the corresponding vane 224–226 against the outer peripheral surface 114 of the rotor 14.

A reference numeral 31 denotes communication bores formed through the center housing 1 and the side plate 9, so as to make the delivery chambers 131–133 communicate an auxiliary delivery chamber 134 formed in the housing 3, so as to deliver the refrigerant fed to the delivery chambers 131–133 into the auxiliary delivery chamber 134.

The inner surface of the rear housing 3 opposing to the bearing 12 is slightly recessed as shown in FIG. 2, so as to form a small chamber 32. A narrow passage 33 is formed in the rear housing 3 and the side plate 9, so as to allow the small chamber 32 to communicate with the working chambers. The opening end 233 of the narrow passage 33 is positioned just in front of or leading side of the uppermost vane 224, as shown in FIG. 1, somewhat radially outwardly from the outer peripheral surface 114 of the short-diameter of the elliptic rotor 14.

The compressor having the described construction operates in the manner described hereinafter with reference to FIGS. 5*a* to 5*f*.

Referring first to FIG. 5*a*, one 15 of the longer-diameter portions is positioned to confront the uppermost vane 224. It will be seen that there are three working chambers defined by three vanes 224–226 disposed at 120° intervals, portions 51–53 of inner peripheral surface of the cylinder chamber between adjacent vanes and the outer peripheral surface 114 of the rotor 14.

For an easier understanding of the invention, the description will be made specifically in connection with one 141 (hatched portion in FIG. 5*a*) defined by the inner peripheral surface portion 51.

As the rotor 14 is rotated clockwise from the position as shown in FIG. 5*a*, the working chamber 141 is divided as shown in FIG. 5*b* into two sub-chambers 142, 143. One 142 of these sub-chambers has a volume which gradually increases, so that a vacuum is generated therein. As a result, the refrigerant in the suction chamber 103 in the rotor 14 is sucked into the sub-chamber 142. Meanwhile, the volume of the other sub-chamber 143 is gradually decreased to generate therein a high pressure, so that the refrigerant in the sub-chamber 143 is compressed and delivered to the delivery chamber 132, through the delivery port 127.

As the rotor 14 is further rotated to the position as shown in FIG. 5*c* to place the longer-diameter portion 15 in contact with the vane 225, as shown in FIG. 5*c*, the sub-chamber 143 is extinguished to complete the compression. The sub-chamber 142 continues to suck the refrigerant. The sucking of the refrigerant into the working chamber 141 is ceased when the longer-diameter portion 15 of the rotor 14 and the first suction port 21 have been moved beyond the vane 225, as shown in FIG. 5*d*. In this state, the chamber 141 has the maximum suction volume. As the rotor 14 further rotates from the position as shown in FIG. 5*d*, the working chamber 141 confronting the inner peripheral surface 51 commences the compression.

Then, as the rotor 14 is further rotated to bring the longer-diameter portion 16 to come between the vanes 224, 225, as shown in FIG. 5*e*, the working chamber 141 confronting the inner peripheral surface 51 comes to be divided again into two sub-chambers 142, 143. Then, the sub-chamber 142 sucks the refrigerant through the second suction port 22, while the refrigerant which has been sucked into the subchamber 143 is compressed by the outer peripheral surface 114 of the rotor 14 and discharged to the delivery chamber 132 through the delivery port 127.

Then, as the longer-diameter portion 16 of the rotor 14 is moved to the position of the vane 225 as shown in FIG. 5*f*, the sub-chamber 143 is extinguished to complete the compression. Meanwhile and thereafter, the sub-chamber 142 continues to suck the refrigerant. The sucking of the refrigerant into the working chamber 141 confronting the inner peripheral surface 51 is ceased when the longer-diameter portion 16 of the rotor 14 and the second suction port 22 have been moved beyond the vane 225. The working chamber in this state has the maximum suction volume.

A compression work is commenced in the working chamber 141, as the rotor 14 is further rotated. After the longer-diameter portion 15 has cleared the vane 224, the sucking and compression of the refrigerant are performed in the same manner as described before.

The sucking and compression strokes are performed by other two working chambers 144, 145, in the same manner as that of the working chamber 141. In the described embodiment, each working chamber makes two compression strokes during one rotation of the rotor 14. This means that the total volume of the refrigerant sucked and compressed by the compressor is 6 times as large as that of the aforementioned maximum suction volume.

When the compression stroke is commenced, the lower vanes 225, 226 are retracted into respective vane grooves 124, 125 due to their weights, and are spaced from the outer peripheral surface 114 of the rotor 14. Therefore, the two working chambers confronting the inner peripheral surfaces 51, 52 cannot function even if the rotor 14 is rotated. This problem is however overcome in the following manner.

Namely, the upper vane 224 is always kept in contact with the outer peripheral surface 114 of the rotor 14, due to its weight. Therefore, as the rotor 14 is rotated from the position as shown in FIG. 5*a*, so as to move the longer-diameter portion 16 beyond the vane 226 (See FIG. 5*c*), the working chamber 145 confronting the inner peripheral surface 53 commences a compression, so that the refrigerant is compressed through the delivery port 126 into the delivery chamber 131 (See FIG. 1) to increase the pressure in the latter. As a result, the compressed refrigerant is supplied through the communication bore 31 into the auxiliary delivery chamber 134 so as to increase the pressure in the latter. Then, the compressed refrigerant is delivered from the auxiliary delivery chamber 134 into other two delivery chambers 132, 133 through the communication bore 31, so as to establish a pressure in these two delivery chambers. The established pressure is introduced through passages 30 into the vane grooves 124, 125, so that pressures appear on the inner ends of the vanes 225, 226 soon after the starting of the compressor. As a result, these vanes are pressed against the outer peripheral surface 114 of the rotor 14, so that the working chambers confronting the inner peripheral surfaces 51, 52 become operative.

In the described embodiment, three vanes 224–226 and three delivery chambers 131–133 are provided at 120° intervals in the center housing 1. At the same time, one 224 of the vanes is disposed at the uppermost portion of the cylinder chamber 101, so that it may be pressed onto the rotor 14. The vane grooves 123–125 are made to communicate the delivery chambers 131–133 through passages 30, while the delivery chambers 131–133 are made to communicate one another through the communication bore 31 and the auxiliary delivery chamber 133 in the housing 3. Therefore, the compression is performed only in one working chamber, when the compressor is started. In addition, the compressed gas is spread into three delivery chambers, so that the pressure in the delivery chambers 131–133 is raised gradually or gently. The pressure in the vane grooves 123–125 is increased correspondingly gradually, so that the vanes 224–226 are brought into contact with the rotor surface slowly or gently, in relation to the time, before the full compression is commenced. Therefore, an abrupt pressure increase due to the compression is avoided at the time of starting, even when the pressure in the suction chambers and the working chambers is relatively high just before the starting. Further, since the uppermost vane is pressed onto the rotor surface with a slight force caused only by its weight, the sealing effect of this vane is not so strong. Therefore, when an extraordinary high pressure is generated in the working chamber, due to a liquid-compression or the like, so as to cause a large pressure differential across the vane, this vane is conveniently lifted back to release the impact at the time of starting.

In the described embodiment, the refrigerant in respective vane grooves is forced back to the delivery chambers through the passages 30, during the normal running of the compressor, because the vanes 224–226 are pressed outwardly by the rotor 14. Therefore, by suitably selecting the cross-sectional area of each passage 30, so as to restrict the flow of the refrigerant, the pressure behind the vane in each vane groove is increased, so as to increase the pressure at which each vane contacts the rotor 14. In general, the sealing power has to be increased as the working pressure is increased. According to the invention, for the reason as stated above, the sealing contact pressure of each vane is conveniently increased as the pressure in the working chamber is increased, well fulfilling the above-stated requirement.

Further, the volume in the vane groove behind the vane is increased in the suction stroke, because the vane is projected outwardly from the housing. Consequently, the pressure behind the vane is reduced to lower the pressure at which the vane contacts the rotor 14, so that the wear of the vane and rotor during the suction is reduced to ensure a longer life of the compressor.

As has been described, according to the described first embodiment of the invention, the pressure at which the vanes contact the rotor surface is automatically adjusted to ensure an improved sealing effect and correspondingly increased compression efficiency, and the excessively large contact pressure during the suction stroke is relieved to provide a reduced power loss and prolonged life of the sliding parts.

When the compressor is restarted, after a short suspension caused by the disengagement of the clutch due to the excessive cooling, the pressurized refrigerant still remains behind the vanes, so that the compressor is operated at the maximum capacity from the beginning of the restart. In such a state, no liquid stays in the working chamber, so that the rotor shaft is never subjected to an extraordinarily large shock or mechanical impact.

Hereinafter, an explanation will be made as to how the lubrication is made in each inside part of the housing.

The seal member 13 between the front housing 2 and the rotor shaft 10 is lubricated by the oil content in the refrigerant which has been sucked into the auxiliary suction chamber 104 of the housing 2. The bearing 11 closer to the side plate 8 is lubricated by the oil content of the refrigerant which, due to a lower pressure residing in the suction chamber 103 of the rotor 14 than the pressure in the auxiliary suction chamber 104, passes through the bearing 11.

The oil content of the refrigerant is separated from the refrigerant while it stays in the suction chamber 103, by the centrifugal force caused by the rotation of the rotor 14, and attaches to the inner peripheral surface of the suction chamber 103, so as to stay on the latter. The oil attaching to and staying on the inner peripheral wall of the rotor 14 is accumulated in the oil wells 20 and stored in the latter. This oil is supplied into the area of sliding contact between the side plates 8, 9 and the end surfaces 115 of the rotor, by the action of the centrifugal force and the sliding operation between the side plates 8, 9 and the rotor end surfaces 115. Since the oil attaching to the inner peripheral wall of the rotor 14 is concentrically accumulated at the oil wells 20, a sufficiently large amount of oil is supplied to the sliding parts between the rotor end surface 115 and the side plates 8, 9, so as to ensure a better condition of lubrication at these sliding parts. In addition, the oil stored in these oil wells conveniently enhances the sealing effect, so that the blow-by of the gas coming into the suction chamber 103 through the areas of these sliding contact is reduced, resulting in an improved compression efficiency (volume efficiency).

In the described first embodiment, the shape of the suction chamber formed in the rotor is selected to be similar to that of the outer shape of the rotor. Therefore, the oil separated from the refrigerant in the suction chamber is concentrated and accumulated at the portions of the suction chamber where the radial distance from the axis of the rotor shaft is greatest. These portions suffer the larger wear and generate larger amount of heat than other portions, because the velocity of the sliding movement of the rotor is higher at these positions than at other portions. According to the invention, however, these portions are sufficiently lubricated and effectively cooled, thanks to the above-stated accumulation of the lubrication oil. As a result, the thermal distortion is reduced considerably and the compression efficiency (volume efficiency) as well as the durability of the compressor is remarkably improved. In addition, since the wall thickness of the rotor 14 is substantially uniform and constant over the entire surface of the latter, the rotor can be produced easily by casting without being accompanied by the undesirable formation of blowhole, so that the production cost is lowered appreciably.

The end surfaces of the rotor 14 are lubricated also by the so-called blow-by of the refrigerant (See arrow in FIG. 4) from the working chamber back to the suction chamber 103. Thus, the end surfaces 115 of the rotor 14, where the demand for the lubrication is strict, are conveniently lubricated by larger amount of lubricant than other portion of the rotor. The above-mentioned blow-by is promoted as the compression stroke advances, because the pressure in the working chamber becomes larger, so that the longer-diameter portions of the rotor facing the wall of the working chamber are sufficiently lubricated to the end of the compression stroke. This is convenient for the longer-diameter portions which slide at a larger peripheral velocity.

Further, the lubrication of the bearing 12 closer to the side plate 9 is effected in the following manner. Namely, when the rotor 14 has been rotated to bring its end surfaces 115 away from the opening end 233 of the passage 33 so as to allow the communication of the suction chamber 103 of the rotor 14 with the working chamber 141, i.e. when a chamber 142 of a pressure lower than that of the suction chamber 103 is formed to make the suction stroke, the refrigerant is made to flow from the suction chamber 103 to the chamber 142, through the bearing 12, small chamber 32 and the passage 33, due to the pressure difference. In the course of this flow of the refrigerant, the bearing 12 is efffectively lubricated by the oil content in the refrigerant. The aforementioned passage 33 is sealed by the end surface of the rotor 14, before the compression stroke is commenced, so that the compressed refrigerant is never returned to the suction chamber 103 from the working chamber 141.

It is possible to keep the opened end 233 of the passage 33 unsealed some time after the starting of the compressor, so as to allow the flowing back of the refrigerant, thereby to effect the lubrication. This must be done, however, in such a manner as not to incur a drastic reduction of the volume efficiency. Although only one passage 33 is provided in the described embodiment, it is possible to increase the number of the passage. By doing so, the lubrication effect is increased correspondingly.

It will be understood that, in the described embodiment, the bearing 12 which is usually difficult to lubricate can be forcibly satisfactorily lubricated, thanks to the provision of the passage 33 in the rear housing 3 and the side plate 9 which allows the mutual communication of the small chamber 32 of the bearing opposite to the suction side and the working chamber under sucking stroke.

Figure 6:
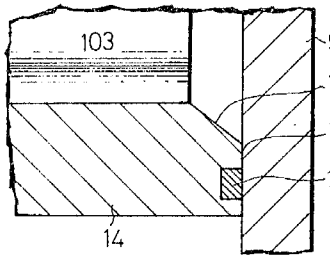
FIGS. 6 and 7 are sectional views showing different forms of oil receiver in the rotor.
Figure 7:
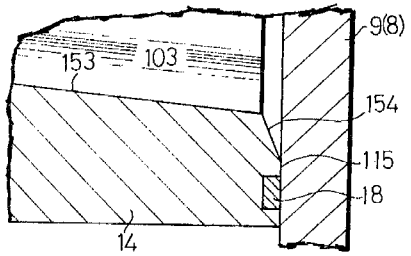

The oil well 20 can have a form other than the stepped groove 151 as shown in FIG. 4. For instance, the oil well 20 may be in the form of a chamferred groove 152 as shown in FIG. 6. Further, it is possible to make use of the extraction slope by which the rotor 14 is extracted from the casting mold, as the oil well 20. Still further, the oil well 20 can have a composite form consisting of the extraction slope 153 and the chamferred surface 154, as shown in FIG. 7. The oil wells 20 may be formed in the side plates 8, 9, if the suction chamber 103 is formed to have a cylindrical form.

Figure 8:
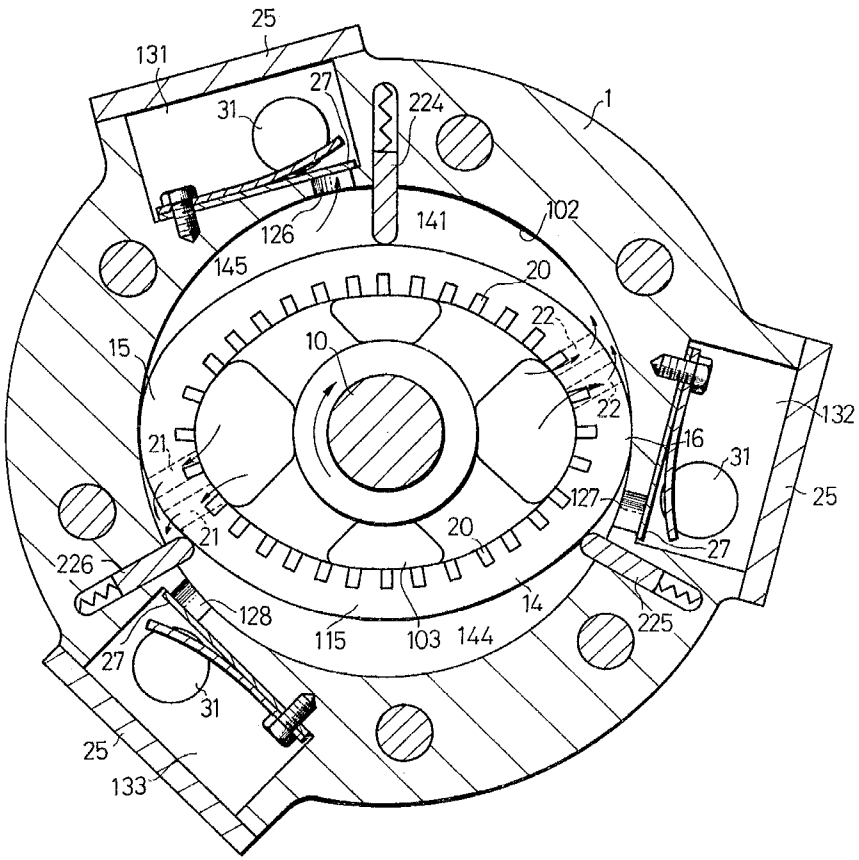
FIG. 8 is a sectional view showing still another form of oil receiver.

As shown in FIG. 8, it is possible to form a plurality of independent and radially disposed oil wells 20 in the inner peripheries of the rotor end surfaces 115, for continuous communication with the suction chamber 103. Alternatively, the oil wells may be formed to extend from the inner peripheral surface 116 of the rotor 14, in the direction tangential to the direction of rotation. According to such arrangements, the oil attaching to the inner peripheral wall is concentrated and accumulated at the oil wells 20. As the oil wells 20 are completely filled with the oil, the surplus oil is concentrated, due to the action of the centrifugal force, to the portions of the inner peripheral wall of the rotor 14 where the radial distance from the axis of the shaft 10 is greatest, i.e. to the portion of the suction chamber 103 close to the larger-diameter portions 15, 16, so as to be stored in these portions. The oil stored in the oil wells 20 is supplied to the frictional part between the rotor end surface 115 and the side plates 8, 9, so as to effectively lubricate such frictional part. The oil in the suction chamber 103 tends to be concentrated to the areas near the longer-diameter portions 15, 16, because of the centrifugal force caused by the rotation of the rotor 14. However, since each of the independent oil wells 20 radially disposed around the periphery of the rotor end surface 115 contain sufficient amount of oil, the sliding parts between the rotor end surface 115 and the side plates 8, 9 are lubricated sufficiently and evenly over the entire periphery. In addition, the portions of the rotor end surface 115 near the longer-diameter portions 15, 16, which slide at a larger velocity than the other portions and, accordingly, suffer a larger wear and higher heat, are conveniently lubricated in quite an effective manner by a sufficient amount of oil centrically accumulated at the portions of the suction chamber 103 near these end-surface portions.

These oil wells function also as mere oil grooves known per se, for supplying the lubricant to the sliding parts to increase the lubrication efficiency.

Further, partly because the outer peripheral surfaces 215, 216 of the longer-diameter portions 15, 16 of the rotor 14 are positioned as close as possible to the inner peripheral surface 102 of the cylinder chamber, as shown in FIG. 3, and partly because each of these peripheral surfaces 215, 216 extends over certain circumferential length as a part of arc having an apex angle $\alpha$ centered on the axis 201 of the rotor shaft, the sealing effect at these surfaces 215, 216 is considerably increased. At the same time, when seal members are disposed on these surfaces 215, 216, these seal members are conveniently lubricated by the oil content of the refrigerant which blows-by from the chamber 143 under compression to the chamber 142.

Further, in the described first embodiment, the rotor 14 received by the cylinder chamber 101 of circular cross-section is provided therein with a suction chamber 103 and first and second suction ports 21, 22 through which the refrigerant is sucked from the suction chamber 103 into the working chamber. Thanks to this arrangement, the rotor 14 is evenly cooled by the refrigerant sucked into the suction chamber 103. At the same time, the refrigerant is sucked into the cylinder chamber 101 from the rotating rotor 14 in such a manner as to be jetted onto the inner peripheral surface of the cylinder chamber 101, through the first and the second suction ports 21, 22, so that the inner peripheral surface 102 of the cylinder chamber 101 is uniformly cooled by the refrigerant. Consequently, the temperature difference between the portions of the rotor 14, as well as the temperature difference between the portions of the cylinder chamber 101 is avoided to prevent the thermal distortion. This in turn contributes to an improvement in the sealing between the rotor 14 and the cylinder chamber 101, resulting in an increased volume efficiency of the compressor, and to the prevention of seizure of the rotor shaft 10, rotor 14 and other parts.

Further, it is to be noted that the flow of the refrigerant from the suction chamber to the working chamber is enhanced to improve the volume efficiency and to reduce the power consumption, because the direction of the centrifugal force acting on the mass of refrigerant due to the rotation of the rotor 14 coincides with that of the movement of the refrigerant which flows toward the working chamber through the first and second suction ports.

In addition, the compressor of this first embodiment can be started smoothly without any mechanical impact or shock, partly because the suction chamber 103 formed in the rotor 14 is effective to reduce the weight of the latter, and partly because only the uppermost vane 224 is kept in contact with the rotor 14 due to its weight, while the other vanes 225, 226 are retracted into respective vane grooves 124, 125 also due to their weights.

At the same time, in the described first embodiment, oil is conveniently supplied to the seal member 13 of the rotor shaft 10, as well as to the bearings 11, 12, by making use of the flow of the refrigerant entering into the suction chamber 103 of the rotor from the suction-side side plate 8 which partially defines the cylinder chamber 101. Particularly, the lubrication between the end surfaces 115 of the rotor 14 and the side plates 8, 9 is effectively made by the oil content of the refrigerant, making efficient use of the centrifugal force caused by the rotation of the rotor 14.

Further, in the described embodiment, the leading first suction ports 121 are formed somewhat behind the rear or trailing end 111 of the longer-diameter portion 15. These suction ports 121, however, may be formed just behind the rear or trailing end 111 of the longer-diameter portion 15. By doing so, the suction stroke is commenced immediately after the trailing end 111 of the longer-diameter portion 15 has cleared the vane 226, so as to ensure a high suction efficiency. At the same time, the suction of the refrigerant into the working chamber 144 is ceased as the vane 226 is passed by the trailing side first suction port 122, and the suction of the refrigerant into the working chamber 145 comes to be made also through the trailing side first suction port 122.

In the described embodiment, as shown in FIGS. 1 and 3, the arrangement is such that the trailing side first suction port 122 is slightly ahead of the vane 226, i.e. the port 122 has been moved just beyond the vane 226, when the volume of the working chamber 144 has become maximum. Provided that, however, that the suction port is positioned just in front of or trailing side of the vane 226 as viewed in the direction of rotation of the rotor, the suction of the refrigerant into the working chamber 144 is continued till the end of the expansion of the volume of the latter, so as to provide a high suction efficiency.

At the same time, in the illustrated embodiment, three vanes 224-226 and three delivery ports 126-128 are formed in the housing, while the suction chamber 103 is formed in the rotor 14. Also, the first and second suction ports are formed in the periphery of the rotor 14. In addition, the first and the second suction ports 21, 22 are so positioned that, when the volume of a working chamber has been expanded to the maximum volume, these two suction ports are located between the leading side vane and the associated longer-diameter portion. Therefore, the reversing of the refrigerant from the working chamber back to the suction chamber 103, through the suction ports 21, 22, is fairly avoided to ensure a high volume efficiency.

Figure 27:
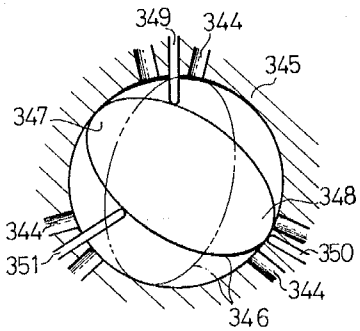
FIG. 27 is a schematic sectional view of a conventional compressor in which both of the suction and delivery ports are provided in a stationary housing.

This advantage will be more clearly understood from an explanation of the prior art. Namely, in the conventional compressor as shown in FIG. 27, the suction port 344 is provided stationarily in the housing 345. Therefore, during the time after the completion of suction where one 348 of the longer-diameter portion of the rotor 346 has passed the vane 350 (illustrated by full lines) and before the other longer-diameter portion 347 of the rotor comes to close the suction port 344 to commence the compression (illustrated by two-dots-and-dash lines), the refrigerant which has been sucked into the working chamber is partially forced back to the suction side, through the suction port 344. Even if the compressor is provided with a suction port formed in the rotor, the reverse flow of the refrigerant from the working chamber to the suction side inevitably takes place to reduce the volume efficiency, during the time after the working chamber has been expanded to its maximum volume and before the suction port is passed by the vane, if the number of the vanes is equal to that of the longer-diameter portion of the rotor.

It is remarkable that such a reduction of the volume efficiency is completely avoided in the compressor of this embodiment. In other words, in the compressor of this embodiment, when the trailing side longer-diameter portion defining the trailing end of a working volume has become to commence the compression, after the volume of the working chamber has been expanded to the maximum, the working chamber has been separated from the suction port by the vane so as to prevent the reversing of the refrigerant, thereby to promise an enhanced volume efficiency of the compressor.

When the first and the second suction ports 21, 22 are disposed just behind the longer-diameter portions 15, 16 of the rotor 14, the sucking of the refrigerant is started through the suction port immediately after the working chamber has become to increase its volume. At the same time, if the arrangement is such that, when a working chamber has expanded to its maximum volume, the suction port is located just in front of or trailing side of the vane positioned at the leading side of the working chamber, the sucking of the refrigerant is continued till the end of the expansion of the volume of the working chamber, i.e. till the end of the expansion stroke of the working chamber.

It is possible to enjoy these two advantages by adopting the following arrangement. Namely, if the arrangement is such that, when the suction volume of a working chamber has become to its maximum, the suction port is located to extend over the vane located at the leading side of the working chamber and the longer-diameter portion of the rotor, the refrigerant is sucked into the working chamber very shortly after the formation of the working chamber, i.e. from an extremely early state of the expansion of the volume of the working chamber. At the same time, according to such an arrangement, the suction of the refrigerant is continued until the volume of the working chamber is increased to its maximum, and is ceased when the volume has become maximum, because the suction port comes to be closed or separated by the vane. As a result, the suction efficiency of the compressor is further improved.

Supposing that the first and the second suction ports 21, 22 are not located such that, when a working chamber has expanded to its maximum volume, these ports are positioned between the leading side vane and the longer-diameter portion of the rotor, the sucking of the refrigerant is commenced with a considerable time lag to the commencement of the expansion of the volume of working chamber, or the working chamber is separated from the suction port before the volume of the working chamber is increased to the maximum. Consequently, a large vacuum is generated in the working chamber which is going to expand, resulting in a heavy load. The problem is, however, fairly overcome by the described embodiment of the invention.

The maximum suction efficiency is obtained by arranging such that each suction port 21, 22 has one end located at the longer-diameter portion or, when the longer-diameter portion has an arcuate outer peripheral surface 215 as in FIG. 3, located at the trailing side end 111 of the longer-diameter portion, while the other end of the suction port is located just in front of or trailing side of the vane which is located at the leading side of the working chamber whose volume has been expanded to the maximum. Such a requirement can be equally fulfilled by a single elongated port having the required circumferential length, and by a plurality of independent ports arranged over the required length.

Further, in the described embodiment, the circumferential width of each suction port 21, 22 is selected to be larger than the thickness of the vane, so that the suction port is never closed completely by the vane, so that a smooth flow of the refrigerant is maintained without any interception.

Hereinafter, a second embodiment of the invention will be described with reference to FIG. 9.

Figure 9:
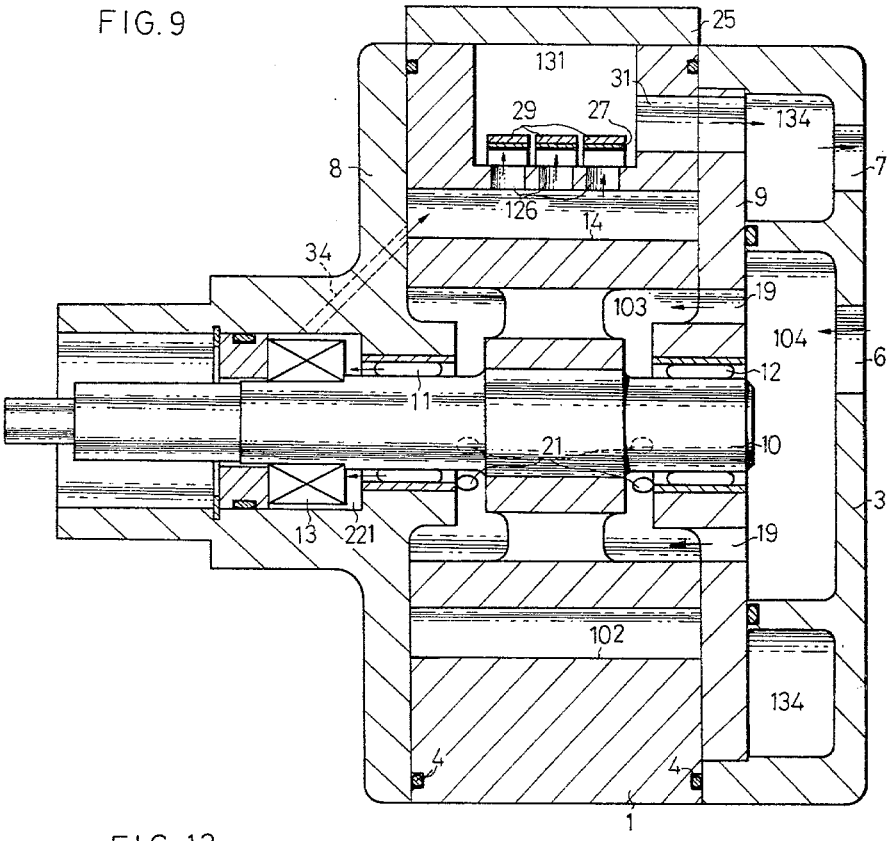
FIG. 9 is a sectional view of a compressor constructed in accordance with a second embodiment of the invention, with a front housing thereof removed.

In this embodiment, as will be seen from FIG. 9, the front side housing 2 is omitted, and a seal chamber 221 enclosing the seal member 13 is formed by a part of the side plate 8. A passage 34 is provided for communication of the seal chamber 221 with a working chamber under suction stroke. At the same time, an auxiliary suction chamber 104 is formed at the center of the rear housing 3. Further, an introduction port 19 is formed in the side plate 9. Other portions than mentioned above are materially identical to those of the first embodiment.

In this embodiment, it is possible to simultaneously lubricate the bearing 11 and the seal member 13. The operation of the compressor and the advantages of the same are equivalent to those of the first embodiment.

Figure 10:
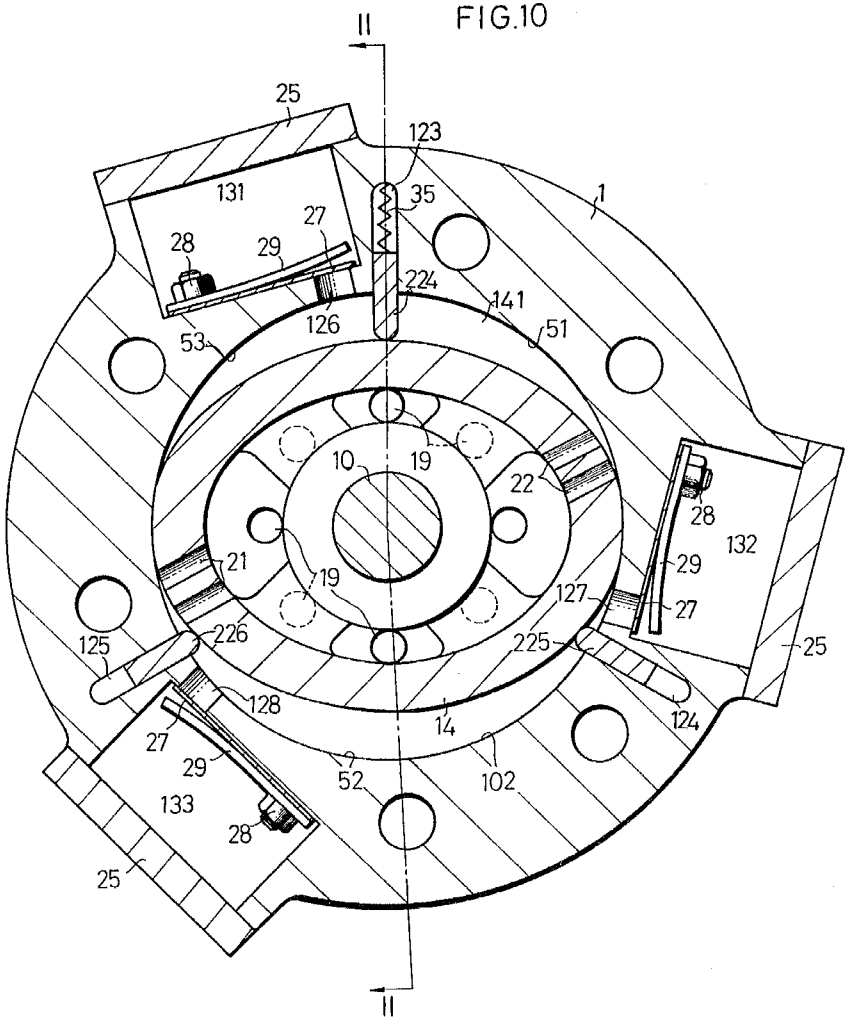
FIG. 10 is a sectional view of a compressor constructed in accordance with a third embodiment of the invention in which vanes of the compressor are biased by means of springs.
Figure 11:
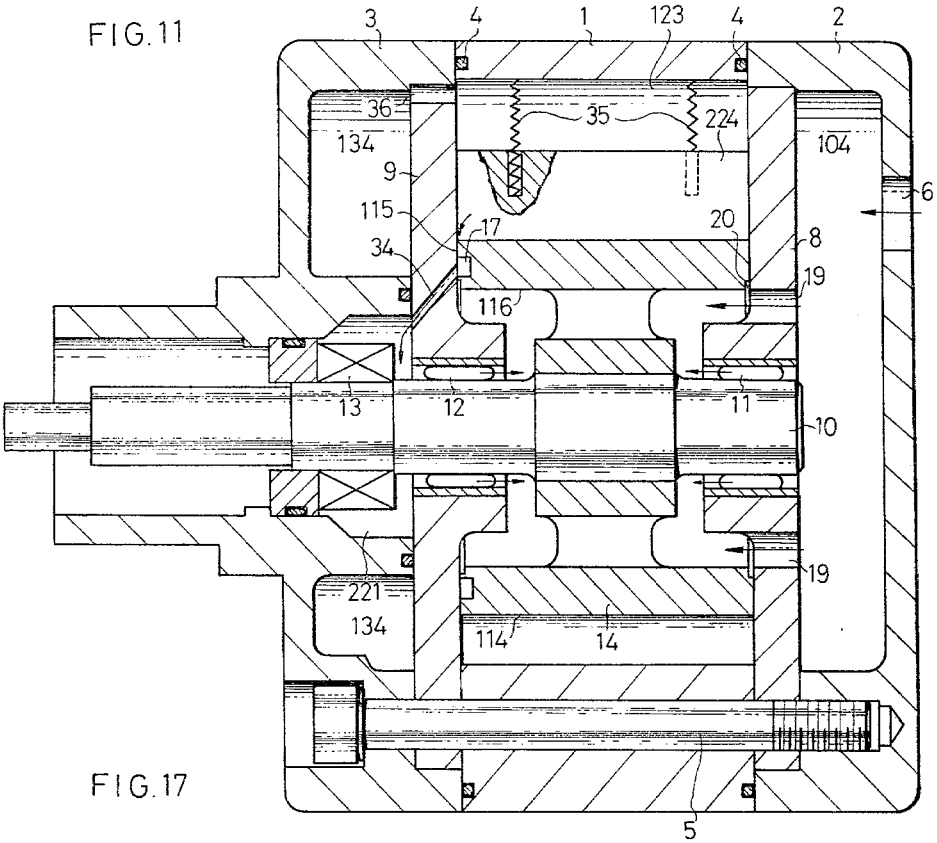
FIG. 11 is a sectional view taken along the line 11—11 of FIG. 10.

FIGS. 10 and 11 show a third embodiment of the invention. In this third embodiment, as shown in FIG. 11, the positions of the combination of the suction side housing 2 and the side plate 8 and the combination of the delivery side housing 3 and the side plate 9 are reversed to those of the first embodiment. At the same time, a seal chamber 221 enclosing the seal member 13 is formed in the housing 3. The seal chamber 221 is made to communicate the seal groove 17 in the end surface 115 of the rotor 14 through a small-diameter passage 34. Further, a coiled spring 35 for biasing the vane 224 toward the rotor 14 is disposed in the vane groove 123. The vane grooves 123–125 are made to communicate with the auxiliary delivery chamber 134 formed in the housing 3, through fine passages 36, respectively. The seal ring fitted to the end surface 115 of the rotor 14 and the seal groove at the suction side are eliminated. Other portions than specifically mentioned above are all identical to those of the first embodiment.

In this embodiment, the vane 224 is pressed against the outer peripheral surface 114 of the rotor by the force of the coiled spring 35, in addition to the force exerted by the pressure of the refrigerant derived from the auxiliary delivery chamber 134. Consequently, the follow-up characteristic of the vane 224 is improved as compared with the first embodiment in which the vane 224 is pressed against the rotor surface only by the force of gravity. As a result, the floating of the vane 224 is prevented, so that the working chamber 141 is put into effect very shortly after the start of the compressor. Other points of operation and advantages are equivalent to those of the first embodiment.

Since the sealing at the end of the vane 224 is enhanced after the establishment of the delivery pressure, the coiled spring 35 has only to have such a small force as being sufficient to promote the establishment of the delivery pressure, so as not to excessively press the vane during normal running of the compressor. The coiled spring 35 may be attached to two or more vanes 225, 226.

Figure 14:
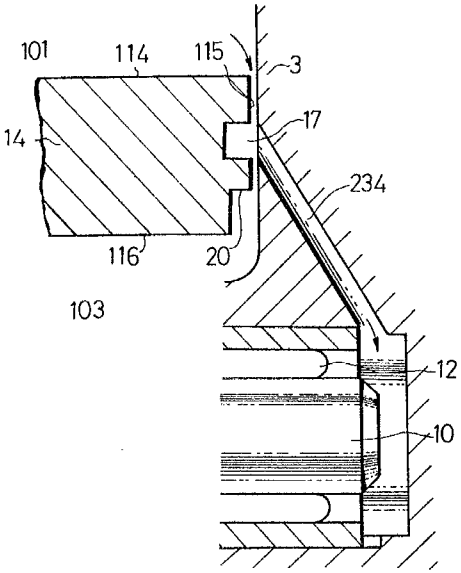
FIG. 14 is an enlarged sectional view of a part of the rotor of the compressor of FIG. 12, specifically showing the passage for communicating the rotor end surface to a small chamber.
Figure 13:
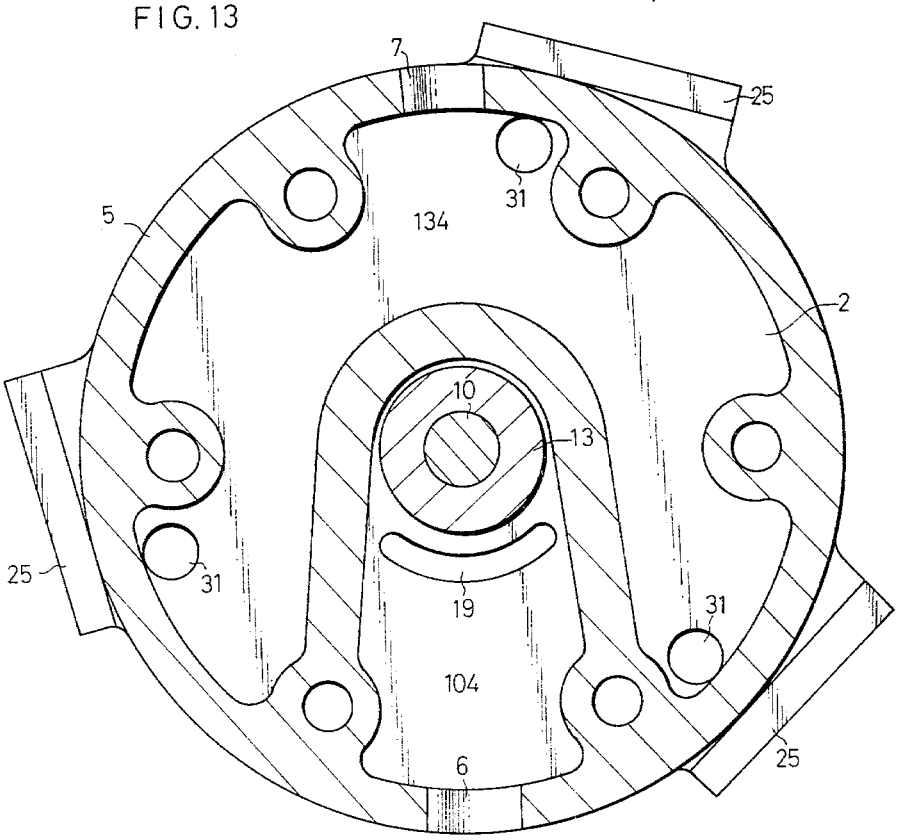
FIG. 13 is a sectional view taken along the line 13—13 of FIG. 12.
Figure 12:
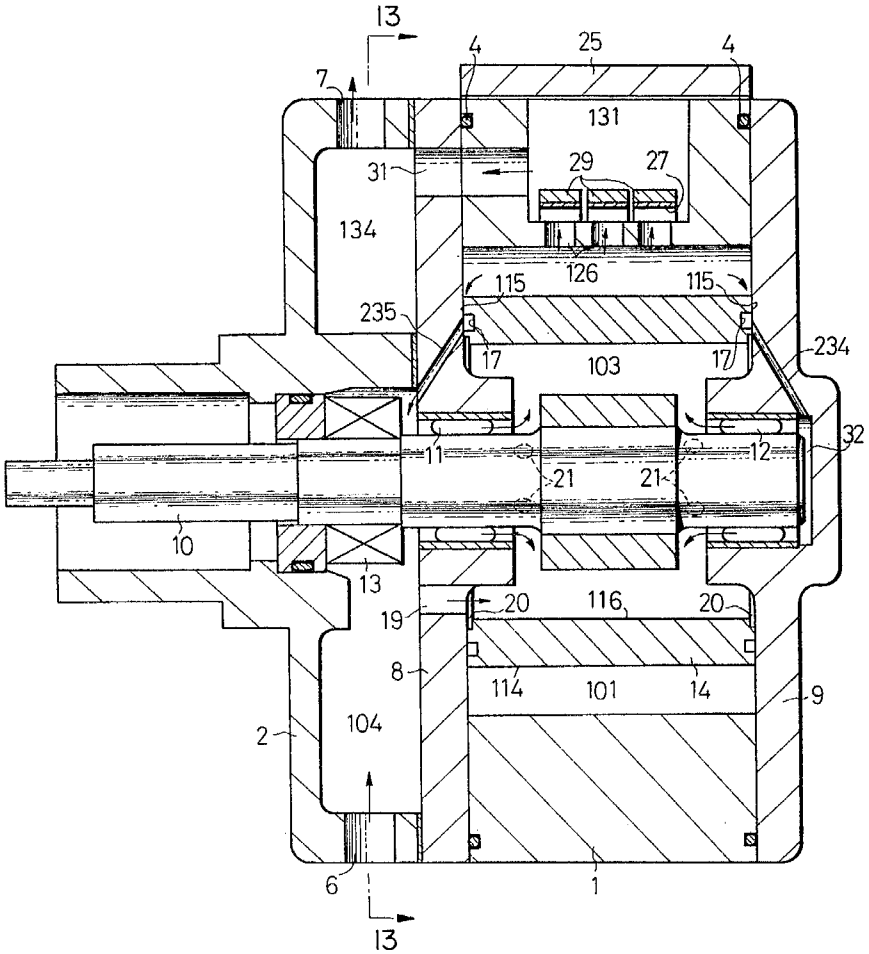
FIG. 12 is a sectional view of a compressor constructed in accordance with a fourth embodiment of the invention, with a rear housing thereof removed.

A fourth embodiment of the invention will be described hereinafter, with reference to FIGS. 12 to 14. In this embodiment, the rear housing 3 is omitted, and an auxiliary suction chamber 104 is disposed within the housing 2 at a lower portion of the latter. The aforementioned small chamber 32 is formed at the inside of the side plate 9.

A reference numeral 234 denotes a fine passage formed in the side plate 9, by which the seal groove 17 in the end surface of the rotor 14 is made to communicate the small chamber 32. The passage 234 is adapted to communicate the seal groove 17 when the shorter-diameter portion of the rotor 14 has been moved near the uppermost position. A reference numeral 235 denotes a fine passage formed in the side plate 8 and adapted to make the seal groove 17 of the rotor end surface communicate the auxiliary suction chamber 104. The opened end of the passage closer to the auxiliary suction chamber 104 is located in the vicinity of the seal member 13 and the bearing 11.

According to this arrangement, when the seal groove 17 comes to communicate the passage 234 during the rotation of the rotor 14 (the communication is made twice for one rotation of the rotor 14, because the seal groove 17 has an oval shape), the refrigerant blows-by through the seal groove 17 and then flows back to the suction chamber 103 via the passage 234 and the small chamber 32 and then through the bearing 12. As a result, the bearing 12 closer to the side plate 9 is lubricated by the oil suspended by the refrigerant. Similarly, the seal member 13 in the auxiliary suction chamber 104 and the bearing 11 are lubricated by the oil suspended by the refrigerant which flows back from the seal groove 17 to the auxiliary suction chamber 104 via the passage 235.

In this fourth embodiment, the seal member 13 and the bearing 11 are lubricated mainly by the refrigerant which flows through the aperture 6 back to the auxiliary suction chamber 104. Thus, the lubricating effect provided by the passage 235 is most advantageous when the seal chamber (not shown) enclosing the seal member 13 in airtight manner is formed independently of the auxiliary suction chamber 104.

Thus, in this fourth embodiment of the invention, seal grooves 17 are formed at both end surfaces 115 of the rotor 14, and passages 234 and 235 are formed in the side plates 8, 9 so as to make the respective seal grooves 17 communicate with the small chamber 32 and the auxiliary suction chamber 104, so that the bearings 11, 12, as well as the seal member 13 are effectively lubricated by the flows of refrigerant back to the suction chamber 103, thereby to improve the durability of the associated parts.

Also, in this fourth embodiment, only the front side housing is provided, and the auxiliary suction chamber 104 and the auxiliary delivery chamber 134 are formed in this front side housing 2. Namely, the rear side housing is omitted. As a result, the size and weight of the compressor as a whole are considerably reduced and the cost of the compressor is advantageously lowered.

Figure 15:
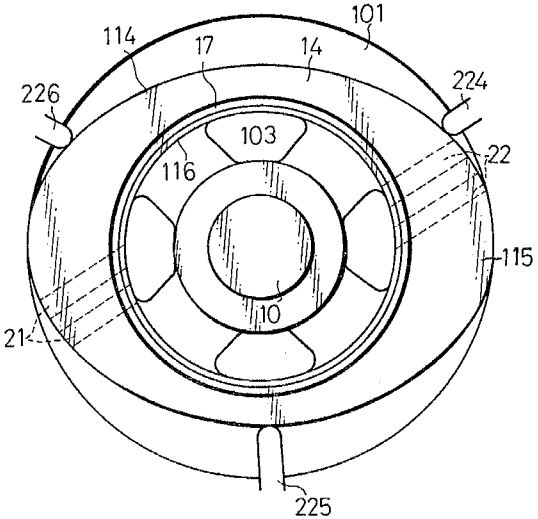
FIG. 15 is a schematic illustration of another form of seal groove in the fourth embodiment.

As shown in FIG. 15, the seal grooves 17 may be formed circularly, for continuous communication with the passages 234, 235. At the same time, a plurality of concentric seal grooves may be formed at each end of the rotor 14. Such a plurality of seal grooves provides a labyrinth effect to the blow-by gas which flows from the working chamber back to the suction side.

Figure 16:
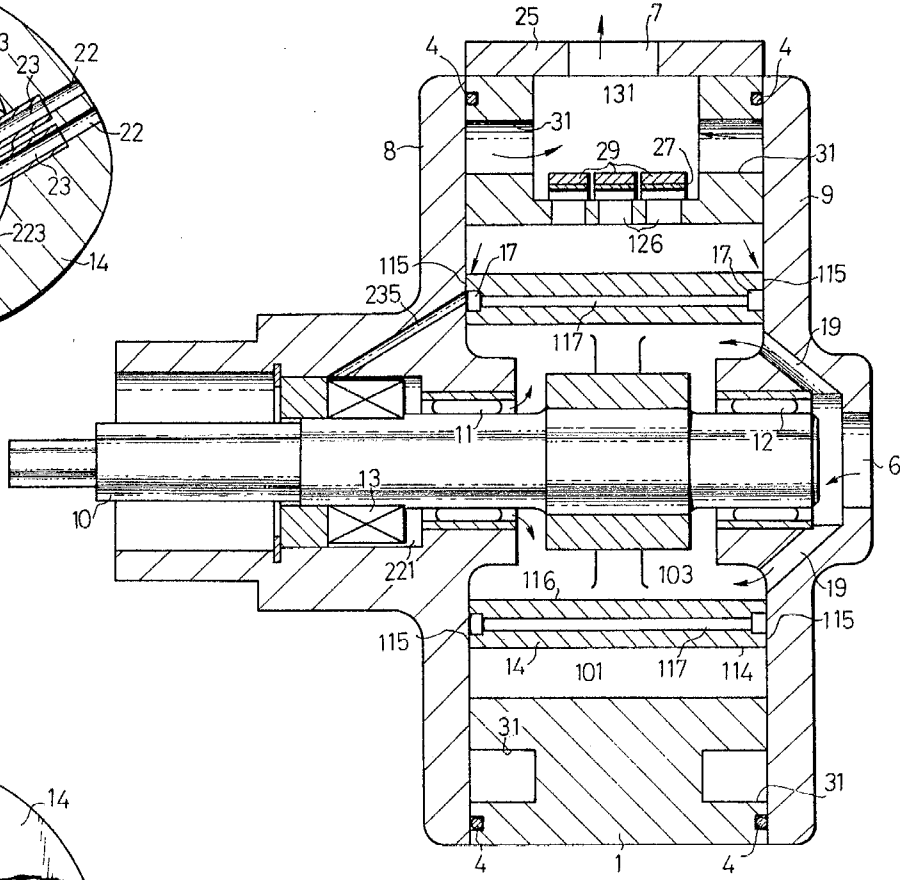
FIG. 16 is a sectional view of a modification of the fourth embodiment.

Further, the pair of seal grooves 17 formed in respective end surfaces of the rotor 14 in this embodiment may be communicated with each other, through a plurality of passages 117 which extends axially through the rotor 14, as shown in FIG. 16. In the example as shown in FIG. 16, the front and rear housings are omitted, and the passage 235 formed in the side plate 8 openes at its one end in the close proximity of the seal member 13. At the same time, the communication bore 31 is shaped in an annular form so as to extend over the entire periphery of the center housing 1, at each axial end of the latter. Further, the aperture 6 through which the fluid is sucked into the suction chamber 103 is formed at the center of the rear-side side plate 9, while the aperture 7 for delivering the compressed fluid out of the cylinder chamber 101 is formed in a lid or cover 25 of the discharge chamber 131.

Hereinafter, different forms of the suction ports 21, 22 formed in the rotor 14 will be described with reference to FIGS. 17 and 18.

Figure 17:
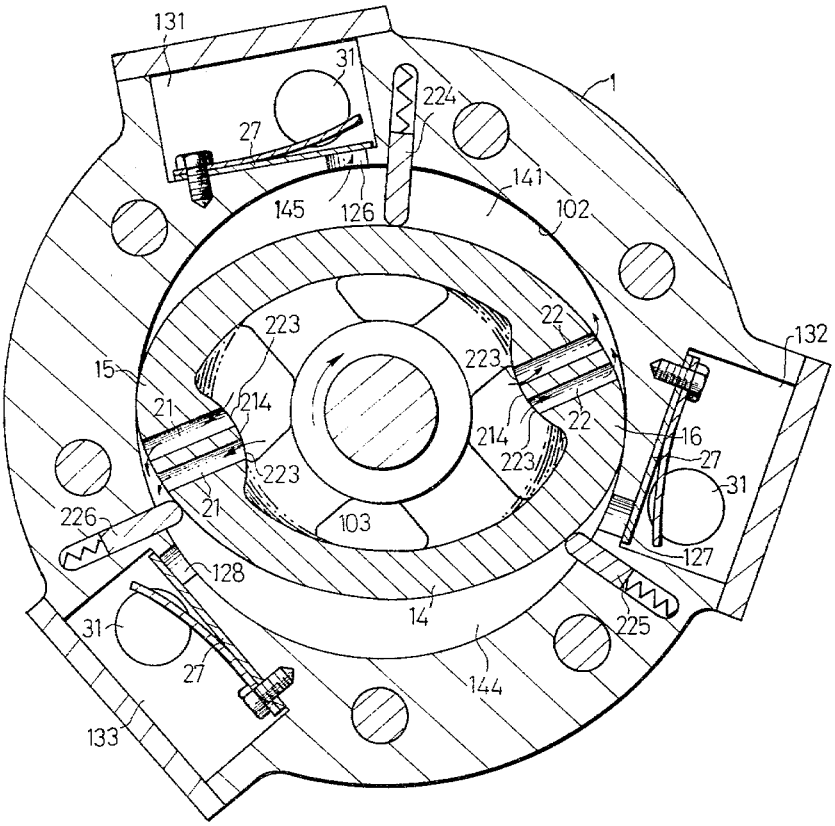
FIG. 17 is a sectional view showing another form of the suction port in the rotor.

Referring first to FIG. 17, the ends of the suction ports 21, 22 closer to the suction chamber 103 open in a protrusion 214 formed on the inner peripheral surface of the rotor 14. Namely, these openings 223 project radially inwardly toward the axis of the shaft, from the inner peripheral surface of the elliptic-cylindrical rotor. In other words, the wall of the suction chamber is partially protruded toward the inside of the chamber at portions thereof where the suction ports open.

Figure 18:
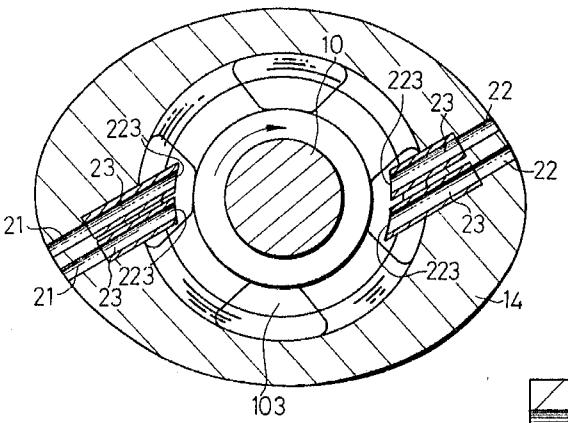
FIG. 18 is a sectional view of the rotor showing still another form of the suction port of the rotor.
Figure 20:
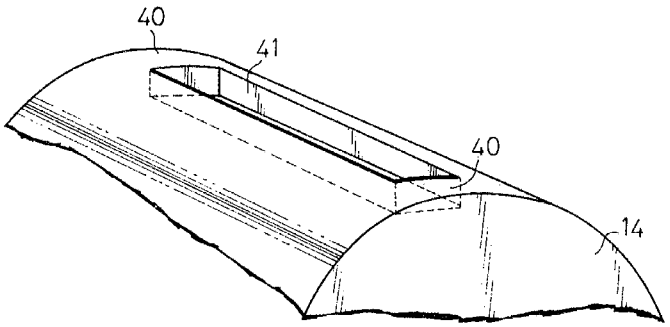
FIG. 20 is a perspective view of a part of the rotor as shown in FIG. 19, showing specifically the longer-diameter portion of the rotor.

Referring now to FIG. 18, the inner peripheral surface of the rotor 14 constituting the wall of the suction chamber 103 is shaped into a cylindrical form. At the same time, insteadly forming the protrusion 214 on the inner peripheral surface of the rotor, pipes 23 are fitted to the suction ports and are extended toward the inside of the suction chamber 103, so that the openings of the suction ports closer to the suction chamber 103 may be projected toward the inside of the latter.

In the compressors constructed as shown in FIGS. 17 and 18, the oil content of the refrigerant in the suction chamber 103 is separated from the refrigerant as the rotor 14 rotates, due to the action of the centrifugal force, and attaches to the inner peripheral surface of the rotor 14. This separated oil is accumulated at the longer-diameter portions of the elliptic inner peripheral surface of the rotor, when the inner peripheral surface is shaped into an elliptic form as shown in FIG. 17, and, when the inner peripheral surface of the rotor has a cylindrical form as shown in FIG. 18, attaches to the whole inner peripheral surface in the form of a layer of uniform thickness.

In the examples as shown in FIGS. 17 and 18, since the openings 223 of the suction ports 21, 22 closer to the suction chamber 103 projects inwardly from the inner peripheral surface of the rotor toward the axis of the shaft 10, the oil is never carried-over to the working chamber, until the level of the openings 223 is reached by the level of the separated oil which attaches to the inner peripheral surface of the rotor. This oil is conveniently supplied to the sliding parts between the rotor end surfaces 115 and the side plates 8, 9, due to the action of centrifugal force and the sliding movements of these parts, so as to effectively lubricate the latter.

The amount of oil staying in the suction chamber 103 during the normal running can be optimized by suitably selecting the amount of oil staying in the compressor and the length or height of projection of the openings 223 from the inner peripheral surface of the rotor. By optimizing the amount of stay of oil, it becomes possible to maintain a sufficient amount of oil for the lubrication in the suction chamber, accomodating an occasional change in amount of oil attributable to a change in refrigeration load or running speed of the compressor.

When an excessively large amount of oil is stored in the suction chamber, the surplus oil is allowed to flow into the working chamber through the suction ports 21, 22. This oil however effectively lubricates the sliding parts between the vanes and the rotor 14.

Even when a foaming of the refrigerant is happened to be caused due to a drastical reduction of the pressure at the time of starting of the compressor, the oil and refrigerant are separated without delay, due to the action of the centrifugal force, so that the oil may stay in the suction chamber 103. Consequently, the liquid compression can hardly take place, and the insufficient lubrication due to the shortage of the lubricant is avoided, at the time of starting of the compressor.

As has been described, in the examples as shown in FIGS. 17 and 18, the openings of the suction ports, through which the working chamber defined by the rotor and center housing is communicated with the suction chamber in the rotor, are made to project inwardly from the inner peripheral surface of the rotor toward the axis of the rotor shaft. Consequently, the oil content separated from the refrigerant in the suction chamber is not allowed to directly flow into the working chamber. Rather, the oil is made to stay in the suction chamber. This offers the following chamber has only a small oil content, so that the volume efficiency of the compressor is improved to ensure a higher refrigeration efficiency of the refrigerator. Secondly, the liquid compression is avoided to protect the parts of the compressor and refrigeration system against breakage. Thirdly, the oil accumulated in the suction chamber is supplied to the sliding parts between the end surfaces of the rotor and the side plates, so as to improve the lubricating condition, thereby to improve the durability of the compressor.

In the suction chamber, the density or concentration of the refrigerant tends to become greater as it radiates from the axis of the shaft, i.e. as it comes closer to the peripheral surface of the suction chamber, due to the action of the centrifugal force, and the refrigeration power tends to become excessively large when the running speed of the compressor is high. The increase of the density of the sucked refrigerant becomes large as the speed of the compressor is increased due to the correspondingly large centrifugal force, so as to enhance the tendency of excessive refrigerating power.

According to the invention, the refrigerating power is prevented from excessively large, because the openings of the suction ports are projected inwardly of the suction chamber, so as not only to increase the flow resistance of the refrigerant through the suction ports but also to allow the sucking of refrigerant of low density residing away from the surface of the suction chamber.

Different forms of the sealing structure between the longer-diameter portions 15, 16 of the rotor 14 and the inner surface of the center housing 1 will be described hereinunder, with specific reference to FIGS. 19 to 23.

Figure 19:
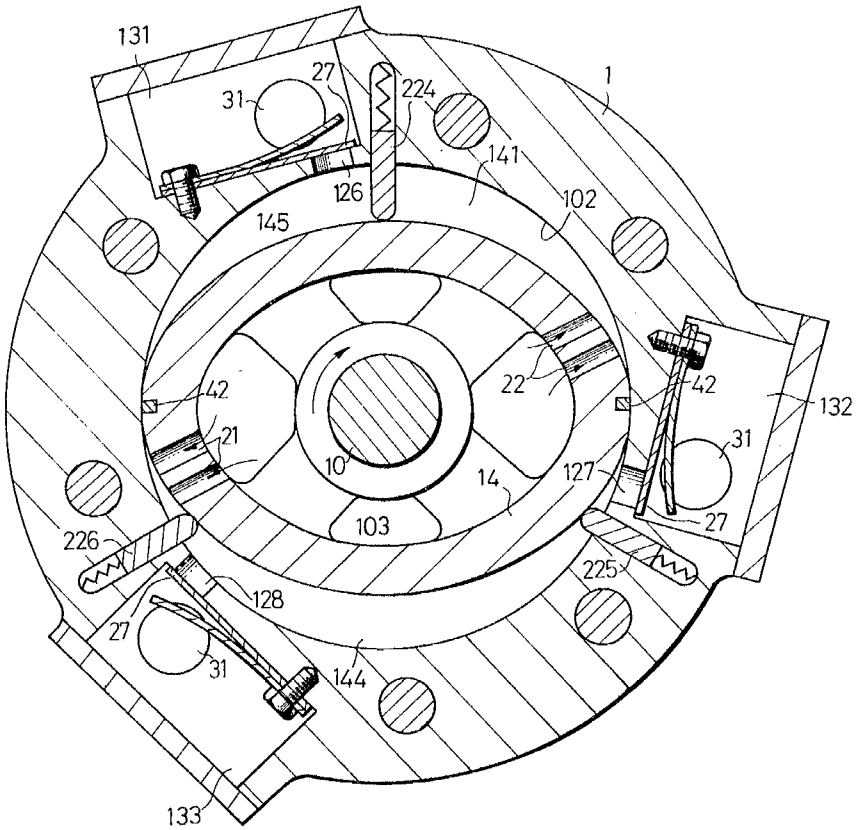
FIG. 19 is a sectional view of the rotor, in which a seal member is attached to the longer-diameter portion of the rotor.
Figure 23:
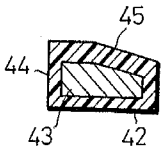
FIG. 23 is a sectional view of another example of the seal member.

In these examples, as shown in FIG. 19, a seal groove 41 is formed in each sealing part of the rotor 14, so as to extend in the axial direction of the rotor over the entire axial length excepting both axial end portions 40. Each seal groove 41 receives a seal member 42 of a height equal to or somewhat smaller than the depth of the groove 41. The upper or radially outer surface of the seal member 42 is adapted to make a sliding contact with the inner peripheral surface 102 of the center housing. The seal member 42 may be made of an ethylene fluoride such as ethylene difluoride, ethylene trifluoride and ethylene tetrafluoride or a copolymer of the ethylene fluoride and a vinyl compound such as ethylene. Alternatively, the seal member 42 may be made of a metallic core member 43 coated with one of the above mentioned resins, as shown in FIG. 23.

Figure 21:
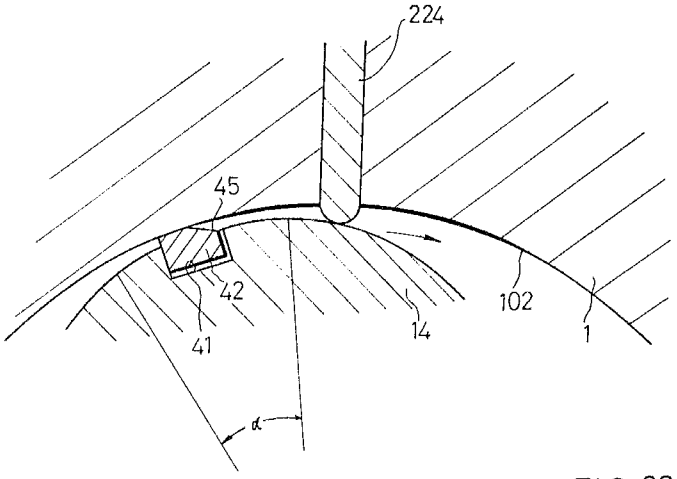
FIGS. 21 and 22 are sectional view of a part of the rotor showing specifically the position of the seal member in relation to the rotor during the rotation of the latter.
Figure 22:
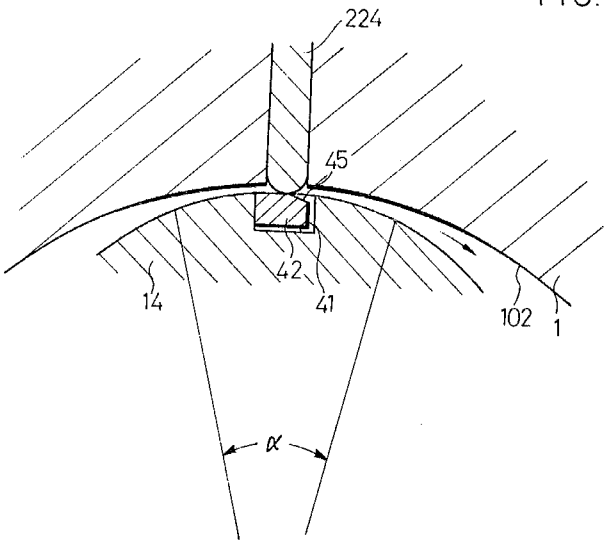

The seal member 42 is notched as at 45, at the upper leading side edge thereof, in order to prevent an impacting collision with the end of the vane. The arrangement is such that the notched part 45 of the seal member does not come out of the seal groove 41, even when the seal member 42 is moved to its outermost position in the seal groove 41. The sealing effect at the sealing part of the rotor is further increased, by making the sealing part have an arcuate form of a curvature substantially equal to that of the inner peripheral wall 102 of the cylinder, over an angular range $\alpha$, as shown in FIGS. 21 and 22. When the seal member 42 slides along the inner peripheral surface 102 of the cylinder chamber, the sealing member is pressed against the latter by the centrifugal force and by the back pressure which is derived from the high-pressure side through the fine gap between the wall of the seal groove 41 and the side surface of the seal member 42 to act on the back side of the seal member 42. Since the upper surface of the seal member is made of a flexible material having a good anti-wear and sliding characteristics, the sealing effect at the sealing part of the rotor is considerably improved to ensure a high compression efficiency.

When the vane 224 is passed by the seal member 42, as shown in FIG. 22, the notched part 45 of the seal member 42 first comes to contact with the end of the vane 224 and gently rides over the latter. In addition, the vane 224 does never collide with the trailing side end of the seal groove 41, because the radially inward projection of the vane is limited by the ungrooved axial ends 40 of the sealing part of the rotor. Consequently, the vane 224 is passed by the seal member 42, in quite a smooth manner.

Although it may appear that the sealing effect is deteriorated by the presence of ungrooved both axial end portions 40, the oil attaching to the side plates 8, 9 in the close proximity to these portions are scraped and concentrated to these portions, so as to effectively seal these ungrooved axial end portions 40 of the rotor.

As has been described, according to this example, the condition of seal between the outer peripheral surface of the rotor and the inner peripheral surface of the center housing is considerably improved to increase the compression efficiency and, accordingly, the refrigeration efficiency of the cycle.

At the same time, since the improvement of the sealing effect is achieved mainly by the sealing member disposed at each sealing part of the rotor, the rotor can be produced with a relatively large tolerance. At the same time, impacting noise attributable to the provision of the seal member is effectively prevented and the durability is considerably improved.

The embodiments heretofore described are not exclusive and the invention can be carried out in various manners as stated below.

Figure 24:
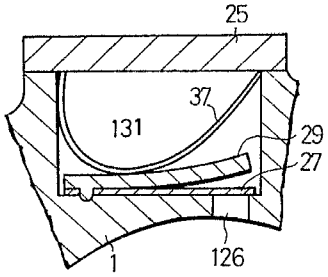
FIG. 24 is a sectional view of a housing, specifically showing means for fixing a stopper provided in the delivery chamber in a central housing.

(a) It is possible, as shown in FIG. 24, to press and retain the check valves and stoppers in respective delivery chambers 131 to 133 by means of arcuate leaf springs 37. By doing so, the mounting and demounting of the check valve 37 are considerably facilitated to allow an easy protective inspection and repair.

Figure 25:
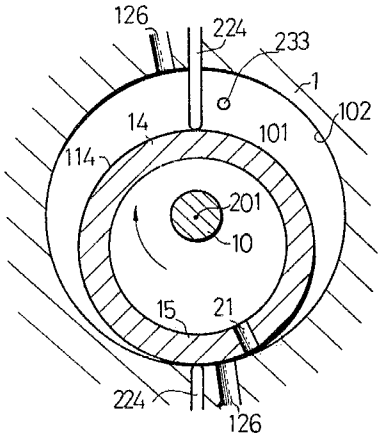
FIG. 25 is a schematic sectional view of a compressor having a rotor provided with only one longer-diameter portion.

(b) It is possible to shape the rotor 14 to have a circular cross-section as shown in FIG. 25, such that only a portion of the outer peripheral surface 114 of the rotor 14 makes a gas tight sliding contact with the inner peripheral surface 102 of the cylinder chamber 101. In such a case, the suction port 21 of the rotor 14 is single, and the vane 224 and the delivery port 126 of the cylinder chamber are a couple. This makes the construction quite simple and facilitates the production. In this example, the centroid of the rotor 14 has to be positioned on the axis 201 of the shaft 10.

Figure 26:
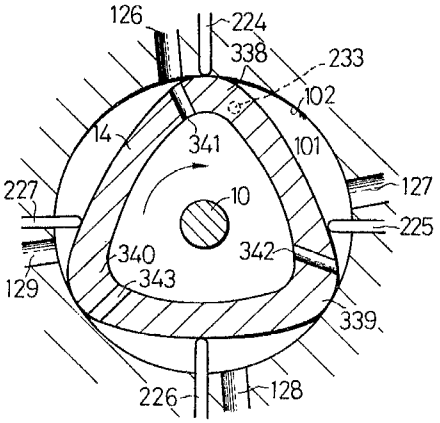
FIG. 26 is a schematic sectional view of a compressor having a rotor provided with three longer-diameter portions.

(c) The rotor 14 may have a substantially triangular form having rounded apices as shown in FIG. 26. In this case, the rotor 14 has three longer-diameter portions 338 to 340 for gas tight sliding contacts with the inner peripheral surface 102 of the cylinder chamber 101. At the same time, first to third suction ports 341 to 343 are formed in the rotor at portions of the latter just behind the longer-diameter portions 338 to 340. Further, four vanes 224 to 227 are provided on the inner peripheral surface 102 of the cylinder chamber 101 at 90° intervals. Delivery ports 126 to 129 are formed just behind respective vanes 224–227. This arrangement affords a compression of a larger volume of refrigerant than any other described embodiment does, and the thermal distortion of the rotor 14 and cylinder chamber 101 due to the local heating and cooling is further diminished. It is also possible to make the rotor 14 have a polygonal cross-section having four or more longer-diameter portions. In such a case, the numbers of the suction ports, vanes and the delivery ports are increased correspondingly.

(d) The supply of the lubrication oil will be made more efficiently in a more concentrated manner, by an additional provision of an oil pump and an oil reserve.

(e) Although the compressor in accordance with the invention has been described to be suitably used as a compressor for compressing the refrigerant in vehicle-mounted air conditioner, the compressor can be used for various other purposes, e.g. various gaseous mediums and even liquids.

Although the invention has been described in detail to some extent through specific preferred embodiments, these embodiments are not exclusive and, as will be clearly understood by those skilled in the art, various changes and modification may be imparted thereto, without departing from the spirit and scope of the invention which are solely limited by the statement of the appended claims.

What is claimed is:

1. A vane type rotary compressor comprising:

a cylindrical housing having front and rear side plates for closing longitudinal ends of said housing;

a rotor rotatably disposed in said cylindrical housing for constituting a cylinder chamber between said cylindrical housing and said rotor, said rotor having at least one longer-diameter portion with the same curvature as that of an inner surface of said cylindrical housing which constitutes, in cooperation with the inner peripheral surface of said cylindrical housing, a sealing portion between said cylindrical housing and said rotor, said rotor extending between said side plates and making gas tight sliding contact with said side plates when it is rotated;

a suction chamber defined in said rotor for sucking a fluid to be compressed from the outside of said housing, said suction chamber extending in the inside of said rotor from the one side plate to the other side plate of said housing such that an inner surface of said rotor is directly in contact with said side plates for providing a gas tight seal and lubrication therebetween by the fluid sucked into the suction chamber;

a plurality of vanes disposed in said housing and with their inner ends engaging the outer peripheral surface of said rotor with sliding contact, so as to divide said cylinder chamber into at least two working chambers, the number of said vanes being one more than the number of said longer-diameter portions of said rotor;

at least one suction port formed through the wall of said rotor for communicating between said suction chamber and one of said working chambers, said suction port being located such that, when the volume of one of said working chambers has been expanded to the maximum for compression of the sucked fluid as a result of the rotation of said rotor by power applied from outside, said suction port is positioned immediately beyond that vane that defines the leading edge of the respective working chamber and said suction port is immediately behind the respective longer-diameter portion of the rotor; and delivery ports located in said housing to deliver fluid compressed in said working chambers to the outside of said housing, the number of said delivery ports being as many as that of the working chambers.

2. A rotary compressor as claimed in claim 1, in which said cylindrical housing includes a plurality of vane grooves slidably receiving said vanes respectively, and a plurality of passages adapted to be communicated between innermost ends of said vane grooves and said delivery ports to introduce pressurized fluid compressed in said working chamber into said vane grooves through said delivery ports so that said vanes are compressed toward said rotor in accordance with pressure in said working chamber.

3. A rotary compressor as claimed in claim 2, in which said rotor is of an elliptic-cylindrical configuration to form two longer diameter portions and includes two suction ports therein, and three vanes are provided in said cylindrical housing at 120° intervals to divide said cylinder chamber into three working chambers, one vane being located in uppermost portion of said cylindrical housing.

4. A rotary compressor as claimed in claim 3, in which said uppermost vane is at least provided with a spring to compress said vane inwardly to thereby continuously contact said vane with said outer surface of said rotor.

5. A rotary compressor as claimed in claim 1 or 2, further comprising sealing means located outside said long diameter portion of said rotor, said sealing means extending parallel to an axis of said rotor to thereby form the well sealed cylinder chamber between said cylindrical housing and said rotor.

6. A rotary compressor as claimed in claim 1 or 2, in which said rotor includes a rotor shaft rotationally situated on front and rear bearings in said side plates of said cylindrical housing, said front and rear bearings being lubricated by said fluid when operated.

7. A rotary compressor as claimed in claim 6, in which said rotor further includes an elliptical inner surface to partially accumulate the fluid sucked into said suction chamber thereat by centrifugal power due to rotation of said rotor so that oil ingredient contained in said fluid is continuously supplied to end portions of said rotor which is in contact with said side plates.

8. A rotary compressor as claimed in claim 7, in which said elliptical inner surface of said rotor includes annular expansions at the end portions of said rotor to keep the oil ingredient therein for lubrication.

9. A rotary compressor as claimed in claim 7, in which said elliptical inner surface of said rotor includes at end portions thereof a plurality of oil wells radially outwardly extending from the inner surface of said rotor and spaced from each other to keep the oil ingredient therein for lubrication.

10. A rotary compressor as claimed in claim 7, further comprising a front housing attached to said front side plate of said cylindrical housing and having an auxiliary suction chamber therein for introducing the fluid into said suction chamber of said rotor, a rear housing attached to said rear plate of said cylindrical housing and having an auxiliary delivery chamber therein for exhausting the fluid from the delivery port to outside, and a rear flow path extending from behind said rear bearing to said cylinder chamber through said rear housing and rear side plate, said fluid partly flowing into said suction chamber through said front bearing when said fluid is sucked into said suction chamber and also partly flowing into said working chamber from said suction chamber through said rear bearing and said rear flow path when the working chamber is in suction stroke.

11. A rotary compressor as claimed in claim 7, further comprising a rear housing attached to said rear side plate of said cylindrical housing, said rear housing having an auxiliary suction chamber in the center of said rear housing for introducing the fluid into said suction chamber of said rotor and an auxiliary delivery chamber outside said auxiliary suction chamber for exhausting the fluid from the delivery port to outside, and a front flow path in said front side plate extending from behind said front bearing to said cylinder chamber, said fluid partly flowing into said suction chamber through said rear bearing when said fluid is sucked into said suction chamber and partly flowing into said working chamber from said suction chamber through said front bearing and said front flow path when the working chamber is in suction stroke.

12. A rotary compressor as claimed in claim 6, in which said rotor further includes at least one groove extending inwardly from one of vertical end portions of said rotor, said groove communicating with said suction chamber so that when the working chamber is in compression stroke, the fluid in the working chamber is flown into said groove to return to said suction chamber for lubrication between the side plates of the cylindrical housing and the rotor.

13. A rotary compressor as claimed in claim 12, in which said groove is located in the front end portion of said rotor, and said cylindrical housing includes a front housing attached to said front side plate thereof and having an auxiliary delivery chamber therein for exhausting the fluid from the delivery port to outside, a rear housing attached to said rear side plate of said cylindrical housing and having an auxiliary suction chamber therein for introducing the fluid into said suction chamber of said rotor, and a front flow path in said front side plate extending from behind said front bearing to said front groove, said fluid partly flowing into said suction chamber through said rear bearing when said fluid is sucked into said suction chamber and also flowing back from said working chamber into said suction chamber through said front groove, front flow path and front bearing when said working chamber is in compression stroke.

14. A rotary compressor as claimed in claim 12, in which front and rear grooves are provided in said vertical end portions of said rotor respectively, and said cylindrical housing includes a front housing attached to said front side plate thereof, said front housing having an auxiliary suction chamber in the center of said front housing for introducing the fluid into said suction chamber of said rotor and an auxiliary delivery chamber outside said auxiliary suction chamber for exhausting the fluid from the delivery ports to outside, a front flow path in said front side plate for communicating said front groove and said auxiliary suction chamber, and a rear flow path in said rear side plate extending from behind said rear bearing to said rear groove, said fluid partly flowing into said suction chamber through said front bearing when said fluid is sucked into said suction chamber, said fluid partly flowing back from said working chamber into said suction chamber through said rear groove, rear flow path and rear bearing and also partly flowing back to said auxiliary suction chamber through said front groove and said front flow path when said working chamber is in compression stroke.

15. A rotary compressor as claimed in claim 12, in which front and rear grooves are provided in said vertical end portions of said rotor respectively, said front and rear grooves being communicated with each other by means of at least one bore extending through said rotor, and said front side wall includes a front flow path extending from said front groove to behind said front bearing, said fluid being supplied to said suction chamber from behind said rear bearing and exhausted outside directly from said delivery ports, said fluid partly flowing into said suction chamber through said rear bearing when the fluid is sucked into said suction chamber and partly flowing back from said working chamber into said suction chamber through said front and rear grooves, front flow path and front bearing when said working chamber is in compression stroke.

* * * * *